United States Patent [19]

Mock et al.

[11] Patent Number: 4,624,581

[45] Date of Patent: Nov. 25, 1986

[54] WRIST WATCH HAVING A BRACELET ATTACHED TO THE WATCH CASING BY A HINGE

[75] Inventors: Elmar Mock, Bienne; Alphonse Bron, Bassecourt, both of Switzerland

[73] Assignee: ETA S.A., Fabriques d'Ebauches, Granges, Switzerland

[21] Appl. No.: 769,128

[22] Filed: Aug. 26, 1985

Related U.S. Application Data

[63] Continuation of Ser. No. 722,986, Apr. 15, 1985, Pat. No. 4,561,077, which is a continuation of Ser. No. 498,822, May 27, 1983, abandoned.

[30] Foreign Application Priority Data

Jun. 11, 1982 [CH] Switzerland ..... 3620/82

[51] Int. Cl.[4] ..... G04B 37/00

[52] U.S. Cl. ..... 368/282; 224/164

[58] Field of Search ..... 368/276, 281–282, 368/300–304; 224/164, 167, 169, 174, 177, 179–180

[56] References Cited

U.S. PATENT DOCUMENTS

| | | | |
|---|---|---|---|
| 2,012,765 | 9/1935 | Mathez | 368/282 |
| 2,065,657 | 12/1936 | Coleman | 63/2 |
| 2,191,020 | 2/1940 | Kaufmann | 368/282 |
| 2,219,277 | 10/1940 | Kaufmann | 368/282 |
| 2,319,269 | 5/1943 | Schwalberg | 224/4 |
| 2,446,065 | 7/1948 | Starke | 58/88 |
| 2,619,270 | 11/1952 | Foster | 224/4 |
| 2,667,994 | 2/1954 | Rappaport | 224/4 |
| 3,242,664 | 3/1966 | Lederrey | 58/88 |
| 3,259,283 | 7/1966 | Moinat | 224/4 |
| 3,307,345 | 3/1967 | Cohen | 58/88 |
| 3,908,356 | 9/1975 | Williams | 58/88 |
| 3,968,643 | 7/1976 | Curol | 58/88 |
| 3,977,176 | 8/1976 | Murakami | 58/23 |
| 4,307,824 | 12/1981 | Malamoud | 224/164 |

FOREIGN PATENT DOCUMENTS

| | | | |
|---|---|---|---|
| 239147 | 3/1965 | Austria . | |
| 656448 | 1/1938 | Fed. Rep. of Germany . | |
| 1350544 | 12/1963 | France . | |
| 1578023 | 7/1969 | France . | |
| 2050514 | 6/1970 | France . | |
| 2230309 | 5/1973 | France . | |
| 2251291 | 11/1974 | France . | |
| 3302557 | 2/1975 | France . | |
| 187471 | 11/1936 | Switzerland | 368/282 |
| 250701 | 6/1948 | Switzerland | 368/282 |
| 267737 | 5/1951 | Switzerland | 368/282 |
| 280560 | 5/1952 | Switzerland | 368/282 |
| 405170 | 9/1965 | Switzerland | 368/282 |
| 436138 | 11/1967 | Switzerland . | |
| 545504 | 8/1969 | Switzerland . | |
| 479108 | 11/1969 | Switzerland . | |
| 179155 | 11/1983 | Switzerland . | |
| 298345 | 10/1928 | United Kingdom . | |
| 844290 | 8/1960 | United Kingdom . | |

*Primary Examiner*—Vit W. Miska

*Attorney, Agent, or Firm*—Spensley Horn Jubas & Lubitz

[57] ABSTRACT

A wrist watch has a bracelet connected to the watch casing by hinges. Each hinge comprises four lugs which are formed in one piece with the peripheral casing portion and rim portion of the casing, the lugs defining therebetween three spaces which are each occupied by one of three hinge elements provided at one end of the adjacent bracelet half. The casing is made of plastics material. A metal pivot pin extends through holes formed in the elements.

11 Claims, 4 Drawing Figures

WRIST WATCH HAVING A BRACELET ATTACHED TO THE WATCH CASING BY A HINGE

This is a continuation of application Ser. No. 722,986 filed on 4/15/85, U.S. Pat. No. 4,561,077 which is in turn a continuation of application Ser. No. 498,822 filed 5/27/83, now abandoned.

BACKGROUND OF THE INVENTION

The present invention concerns wrist watches having a bracelet attached to the watch casing by hinges.

The term "hinge" is used to denote a pivot connection between two components and comprising at least one first element fixed to one of the components, at least one second element forming a pivot member.

French Pat. No. 2 251 291 discloses such a wrist watch, wherein the hinges are each formed by an element which is fixed to the casing of the watch, and two elements which are fixed to the bracelet and which are spaced from each other, these two elements flanking the element which is fixed to the casing. A pivot pin passes through all three elements, thereby defining a pivotal axis.

Thus, in the known construction, each hinge comprises only a single element which is fixed with respect to the watch casing, that element taking up the space between the two elements which are fixed to the bracelet. The pivot pin subjects the hinge element which is fixed with respect to the watch casing not only to tensile stresses which are at right angles to the axis of the pin, but also to twisting stresses which are centered at the middle of the pin. Accordingly, this known construction cannot be applied to watch casings of plastics material, as plastics material generally has poor strength against twisting stresses.

In addition, Swiss Pat. No. 405 170 describes a wrist watch in which the bracelet is formed by a plurality of rigid elements, probably of metal, which are each held in contact with an adjoining rigid element, and non-rigidly connected to the latter. The end elements of the bracelet, which are adjacent to the watch casing, are welded to the casing and are attached to the adjacent bracelet elements by means of a pin. Such a construction, which therefore does not use hinges as defined hereinbefore, is also such that it cannot be applied to a casing of plastics material. In fact, the end elements of the bracelet, which are welded to the watch casing, are subjected to mechanical twisting stresses by the immediately adjoining bracelet elements to which they are non-rigidly connected and with which they are held in contact.

SUMMARY OF THE INVENTION

The main object of the present invention is therefore to provide a wrist watch in which the hinges connecting the bracelet to the casing of the watch are compatible with using a watch casing made of plastics material.

In accordance with the invention, at least the peripheral casing portion of the watch casing is made of plastics material and each hinge comprises n first mutually spaced elements (n being an interger greater than 2) which are formed in one piece with the peripheral casing portion, and n−1 second elements which are fixed with respect to the bracelet and which each occupy a space between two adjacent first elements.

By virtue of the above-indicated construction, the pivot member of the hinge in practice subjects the first elements only to tensile stresses which are at right angles to the pivotal axis.

In accordance with a preferred embodiment, each hinge comprises four first hinge elements which are formed integrally with the peripheral casing portion of the watch casing, and three second hinge elements which are formed integrally with the bracelet half adjoining the hinge, each of said elements having a through hole, all the holes being disposed in alignment and having a straight pivot member passing therethrough, the pivot member being a drive fit in the holes in the second elements which it is engaged with clearance in the holes in the first hinge elements.

BRIEF DESCRIPTION OF THE DRAWINGS

Other features and advantages of the invention will be more clearly apparent from the following description of an embodiment of the invention which is given by way of non-limiting example, with reference to the accompanying drawings in which.

DETAILED DESCRIPTION OF A PREFERRED EMBODIMENT

Figure 1:
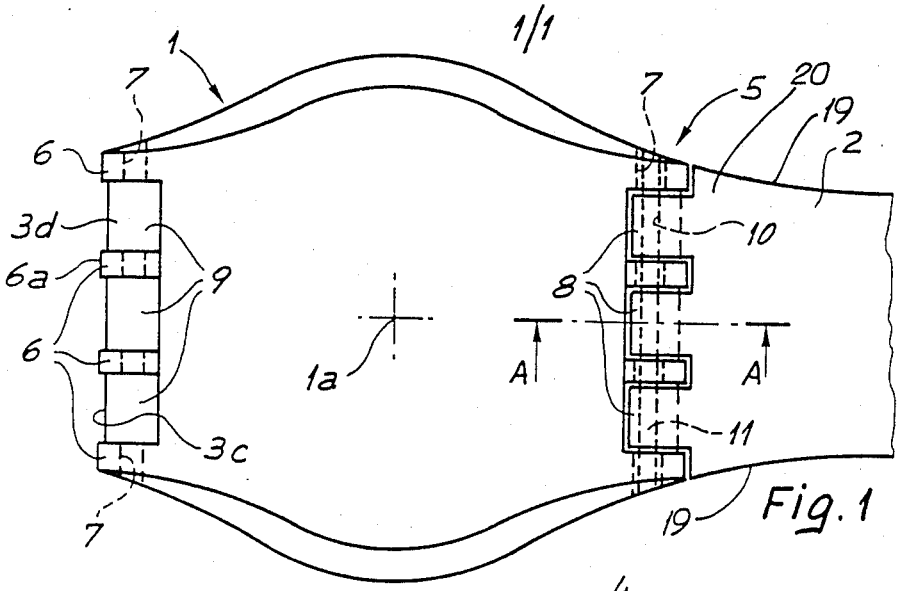
FIG. 1 is a plan view of part of a wrist watch according to the invention.

The wrist watch shown in the drawings comprises a watch casing 1 and a bracelet, of which only one bracelet half is shown, at 2. The casing 1 comprises a bottom or back 3*a*, and a peripheral casing portion 3*b* with a rim which retains a glass 4.

In the illustrated embodiment, the back 3*a* and peripheral portion 3*b* of the casing 1 are made of plastics material in one piece 3, referred to hereinafter as the casing body. In this embodiment, the glass 4 is made of a transparent plastics material and is fixed on the casing portion 3*b* in fluid-tight manner.

The casing body 3 is advantageously made from one of the following three plastics materials: that which is known as ABS (acryl butadiene styrene), that which is known as ASA (acryl styrene acrylester) and that which is known as SAN (styrene acrylonitrile), while the glass 4 may be made of a transparent acrylic resin such as that known under the trademark Plexiglas. The bracelet half 2 may be made either of an elastomer, or a plastics material such as PVC (polyvinyl chloride). The back 3*a* of the casing could be made of metal, set into the peripheral portion 3*b*.

As will be seen from the drawings, the bracelet half 2 is attached to the watch casing 1 by a hinge 5. The hinge 5 comprises an array of four first fixing elements or lugs 6 which are moulded with the casing body 3, the elements 6 being disposed in a side-by-side and spaced relationship and each having a through hole 7 of circular section, the holes 7 all being of the same diameter and being mutually aligned. The hinge 5 further comprises three second fixing elements 8 which are formed in one piece with the bracelet 2, each element 8 being respectively engaged in a space 9 defined between two adjacent first elements 6. Each edge 19 of the bracelet 2 includes a stepped portion 20 which extends to the outer edge of the outer fixing element 6 so to provide a substantially smooth continuous transition between the external side portion of the casing 1 and the edge 19 of the bracelet 2. Each element 8 has a through hole 10 of circular section. The holes 10 are aligned with each other and, when the elements 8 are set into the spaces 9, they are also aligned with the holes 7 in the first hinge elements 6. A straight metal rod or pin 11 of circular section passes through the aligned holes 7 and 10, to form the pivot member of the hinge. In order to prevent any tangential stress from being applied to the first hinge elements 6, the rod 11 is a drive or interference fit in the holes 10, while it is a free fit in the holes 7.

In order to hide the hinge elements 6 and 8, at its side towards the glass 4, the peripheral casing portion **3*b* is provided with a cover wall portion 3*c* which is of such a size as to overhang and mask the hinge elements 6 and 8**, when viewed from above.

The cover portion **3*c* which is formed by moulding with the casing body 3 connects the first hinge elements 6 together and thus contributes to enhancing the mechanical strength of the first hinge elements 6. The cover portion 3*c* has a free edge as shown at 3*d*, which is formed by a part of the external surface of the cover wall portion, that faces towards the back of the watch casing, the edge 3*d* being disposed at a position remote from the centre 1*a* of the watch casing 1. The free edge 3*d*, the cross-section of which is substantially in the form of a circular arc, lies substantially flush with the end 6*a* of the hinge elements 6, which is remote from the centre 1*a*** of the watch casing.

Figure 2:
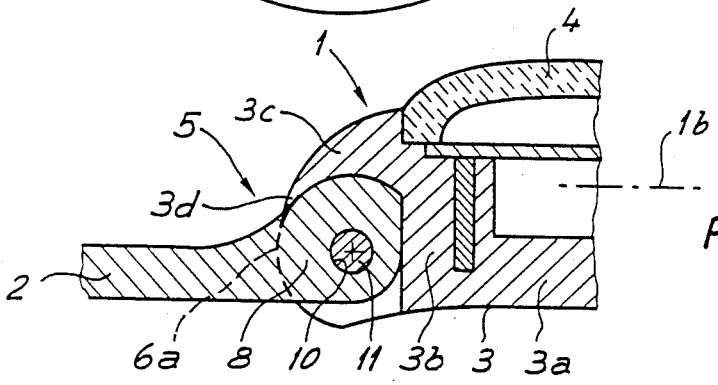
FIG. 2 is an elevational view of part of the wrist watch shown in FIG. 1, in vertical section taken along line A—A in FIG. 1.
Figure 3:
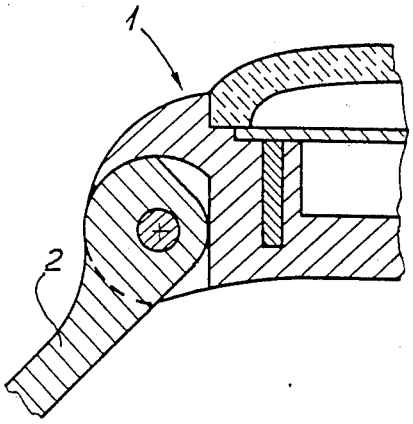
FIG. 3 is a similar view to that shown in FIG. 2, showing the bracelet half in a second angular position relative to the watch casing.
Figure 4:
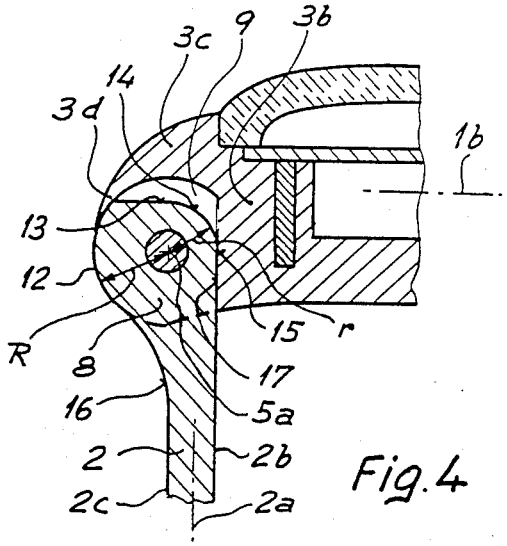
FIG. 4 is a similar view to that shown in FIG. 2, showing the bracelet half in a third angular position relative to the watch casing.

As will be better seen from FIGS. 2 to 4, transversely with respect to the hole 10, each second hinge element 8 is of a cross section, the periphery of which comprises a first arcuate portion 12 centered on the geometrical axis of rotation **5*a* of the hinge 5, a straight portion 13 substantially normal to the general plane 2*a* of the bracelet half 2, a second arcuate portion 14 which is also centered on the axis 5*a*, and a second straight portion 15 which constitutes an extension of the internal surface 2*b* of the bracelet half 2. The internal surface 2*b*** is the surface which is intended to be in contact with the wrist of the person wearing the watch.

The first arcuate portion 12 has a radius R that is substantially equal to the distance between the geometrical axis **5*a* of the hinge 5 and the free edge 3*d* of the cover portion 3*c*. That particular dimension avoids a space remaining between the elements 8 and the edge 3*d*, which is unattractive from the aesthetic point of view. The first arcuate portion 12 is connected to the upper surface 2*b* of the bracelet half 2, by a regular curve 16. At its opposite end, the arcuate portion 12 is connected to the substantially straight portion 13**.

The radius r of the second arcuate portion 14 is less than the radius R of the arcuate portion 12. The radius r is substantially equal to the distance between the geometrical axis **5*a* of the hinge 5 and an external and substantially flat surface 17 of the peripheral casing portion 3*b*, the surface 17 delimiting each space 9, in a direction towards the centre 1*a* of the casing 1. The second arcuate portion 14 is connected on the one hand to the first straight portion 13 and on the other hand to the second straight portion 15 of the cross section of an element 8. The straight portions 13 and 15 are spaced from the geometrical axis 5*a* by a distance substantially equal to r. Finally, in the illustrated embodiment, the two arcuate portions 12 and 14 of the cross section of an element 8** are each of an angular extent that is substantially equal to 90°.

By virtue of the particular configuration of the hinge elements 8 and the particular configuration, as shown in the drawings, of the wall portions defining the spaces 9, the bracelet half 2 can be pivoted relative to the watch casing 1 through a maximum angle of 90° from a first limit position as shown in FIGS. 1 and 2, in which the bracelet half 2 extends parallel to and substantially in the line of the general plane **1*b* of the casing 1, to a second limit position as shown in FIG. 4, in which the bracelet half 2 extends substantially perpendicularly to the general plane 1*b* of the casing 1. The bracelet half 2 is stopped in its first limit position by the flat surface 13 (defined by the cross-sectional portion 13), coming into a position of abutment with the external surface 17. The bracelet half 2 is stopped in its second limit angular position by the flat surface 15 (defined by the cross sectional portion 15), coming into a position of abutment with the surface 17** which thus forms a counter-abutment means.

It will be appreciated that the invention is not limited to the embodiment described hereinbefore with reference to FIGS. 1 to 4 but that in contrast it extends to any other embodiment which falls within the scope of the principle defined by the claims accompanying this description. In particular, it would be possible for the pivot member 11 not to be a drive fit in the holes 10 in the hinge elements 8, but to be simply held axially in the holes 10 by any suitable means. For example, in the portions of the member 11 which are disposed in the holes 10, the member 11 may be smaller in diameter than the diameter of the portions thereof that are fitted in the holes 7 in the first hinge elements 6. If in addition the diameter of the holes 10 is smaller than the diameter of the above-mentioned portions of the member 11, the annular steps which are thus formed between the parts of the axis member 11 which are of different diameters act as means for axially stopping the member 11 with respect to the second hinge elements 8.

What is claimed is:

1. A wrist watch including:

(a) a casing made of plastics material;

(b) two bracelet halves also made of plastics material;

(c) a pair of hinges each for attaching one of said bracelet halves to said casing, each said hinge having a geometrical pivot axis and comprising two first elements on the casing and a second element on said respective bracelet half, aligned holes being provided in said first and second elements; each hinge further comprising:

(d) an axis member inserted in said holes;

(e) abutment means defining first and second end positions of rotation of said bracelet half with respect to said casing, said positions being spaced a predetermined angle apart from each other;

(f) a cover portion integral with the casing and connecting said first elements of said hinge together so as to cover said second element;

(g) said second element having a cylindrical surface coaxial with said geometrical pivot axis;

(h) the radius of said cylindrical surface of said second element being substantially equal to the distance between said axis and the edge of said cover portion remote from said casing, said cylindrical surface extending over an angular sector at least equal to the angle with which said end positions are spaced apart;

(i) said cylindrical surface portion being integral with the upper surface of the bracelet half in a region located on the side of said axis opposite to said casing, the thickness of said region decreasing towards the end of said bracelet half opposed to said hinge.

2. A wrist watch according to claim 1, wherein said cylindrical surface is connected to said upper surface of said bracelet half through a regularly curved surface.

3. A wrist watch according to claim 1 or 2 wherein said second element further comprises:

(a) a first flat surface portion adjacent said cylindrical surface, said first flat surface portion being substantially perpendicular to the general plane of said bracelet half when laid flat;

(b) a cylindrical surface portion centered on said axis of said hinge; and (c) a second flat surface portion connected to the lower surface of said bracelet half, said cylindrical surface portion being between two said first and second flat surface portions.

4. A wrist watch according to claim 3, wherein said cylindrical surface and said cylindrical surface portion each extend over an sector angle of 90°.

5. A wrist watch according to claim 3, wherein said casing has a flat surface portion located beneath said cover portion and extending parallel to said geometrical pivot axis of said hinge and wherein the radius of said cylindrical surface portion is substantially equal to the distance between said axis of said hinge and said flat surface portion of said casing.

6. A wrist watch comprising:

(a) a casing having a face and a back and a peripheral portion of plastic material;

(b) a pair of spaced fixing elements extending from each of two opposite sides of said peripheral portion of said casing, said fixing elements having opposed internal surfaces and opposite outwardly facing surfaces;

(c) two plastic bracelet halves each having an end extending between said opposed internal surfaces of one of said pairs of fixing elements, each of said ends and said pairs of fixing elements having an aligned circular cylindrical hole extending therethrough;

(d) a pivot axis member for each of said bracelet halves extending through the aligned holes in said end and said pair of fixing elements for attaching said bracelet half to the casing for rotation about the axis of said aligned holes;

(e) cover portions integral with said peripheral portion of said casing bridging between each pair of fixing elements on the side of said pivot axis member toward said face for masking the attachment of said bracelet end to said fixing elements and for supporting said fixing elements, each of said masking portions having a free edge parallel to the axis of said aligned holes in the bridged fixing elements;

(f) said end of each said bracelet halves including an enlarged circular cylindrical portion co-axial with said hole therein and having a radius substantially equal to the distance between said free edge of said masking portion and said axis, said cover portions curving smoothly downwardly towards said cylindrical portion of said end to said edge, said edge being of substantially zero thickness, for providing a substantially smooth gapless transition between said cover portion and said cylindrical portion of said end; said bracelet half including a reflexively curved portion between said enlarged cylindrical portion of said end and the rest of said bracelet half for providing a smooth continuously curved transition between said cylindrical portion of said end and the rest of said bracelet half; and (g) abutment means for limiting the rotation of each said bracelet half, said cylindrical portion of said end extending over an angular sector at least equal to that exposed by the permitted rotation of said bracelet half.

7. A wrist watch according to claim 6 wherein said peripheral portion of said casing includes a smoothly curved external side portion extending between one of said fixing elements of one of said pairs and the adjacent fixing element of the other said pairs, the outer surface of said fixing elements being integral and continuous with said external side portions; and wherein each of said end portions of said bracelet halves includes stepped portions extending beyond said opposing internal surfaces of said attached pair of fixing elements for providing a substantially smooth continuous transition between said external side portions of said casing and the edge of said bracelet half.

8. A wrist watch comprising:

(a) a casing having a face and a back and a peripheral portion of plastic material;

(b) a pair of spaced fixing elements extending from each of two opposite sides of said peripheral portion of said casing, said fixing elements having opposed internal surfaces and opposite outwardly facing surfaces;

(c) at least one intermediate fixing element disposed between each of said pairs of fixing elements and extending from and integral with said peripheral portion of said casing;

(d) two plastic bracelet halves each having an end extending between said opposed internal surfaces of one of said pairs of fixing elements and being notched for mating with said intermediate fixing element, each of said ends, and said one pair of fixing elements and said intermediate fixing element having an aligned circular cylindrical hole extending therethrough;

(e) a pivot axis member for each of said bracelet halves extending through the algined holes in said end and said fixing elements for attaching said bracelet half to said casing for rotation about the axis of said aligned holes;

(f) cover portions integral with said peripheral portion of said casing bridging between each pair of fixing elements and said intermediate fixing element on the side of said pivot axis member toward said face for masking the attachment of said bracelet end to said fixing elements and for supporting said fixing elements, each of said masking portions having a free edge parallel to the axis of said algined holes in the bridged fixing elements;

(g) said end of each said bracelet halves including an enlarged circular cylindrical portion co-axial with said hole therein and having a radius substantially equal to the distance between said free edge of said masking portion and said axis, said cover portions curving smoothly downwardly towards said cylindrical portion of said end to said edge, said edge being of substantially zero thickness, for providing a substantially smooth gapless transition between said cover portion and said cylindrical portion of said end; said bracelet half including a reflexively curved portion between said enlarged cylindrical portion of said end and the rest of said bracelet half for providing a smooth continuously curved transition between said cylindrical portion of said end and the rest of said bracelet half; and (h) abutment means for limiting the rotation of each said bracelet half, said cylindrical portion of said end extending over an angular sector at least equal to that exposed by the permitted rotation of said bracelet half.

9. A wrist watch according to claim 8 wherein said peripheral portion of said casing includes a smoothly curved external side portion extending between one of said fixing elements of one of said pairs and the adjacent fixing element of the other said pairs, the outer surface of said fixing elements being integral and continuous with said external side portions; and wherein each of said end portions of said bracelet halves includes stepped portions extending beyond said opposing internal surfaces of said attached pair of fixing elements for providing a substantially smooth continuous transition between said external side portions of said casing and the edge of said bracelet half.

10. The wrist watch of claim 8 wherein the diameter of the hole in each of said ends of said bracelet halves are smaller than that of the aligned holes in said fixing elements, and wherein said pivot axis members are gripped by said hole in said ends and freely rotatable in said aligned holes in said fixing elements.

11. A bracelet for attachment to a wrist watch case which has a back, a peripheral case portion made of a plastic material, side walls in said peripheral case portion which are substantially orthogonal to said back, two arrays of n first fixing elements projecting from said side walls and forming an integral part of said peripheral case portion, the elements of each array being disposed in a side-by-side relationship to form n−1 first spaces therebetween, each fixing element being provided with a hole therethrough, the holes of the n first fixing elements of each being algined along an axis parallel to said back, said peripheral case portion including two masking wall portions projecting from said side walls and being connected to the fixing elements of said arrays, said masking wall portions being disposed on the opposite side of said fixing elements from said back, each first space being partially defined by two adjacent first fixing elements, by a portion of one of said side walls and by the surface of said masking wall portion which faces toward said back, comprising:

two bracelet halves made of a plastic material, each having an internal surface, an external surface and an end for attachment to said case;

a set of n−1 second fixing elements projecting from said end of each of said bracelet halves, said n−1 second fixing elements of each set being spaced and having a length for mating with said n−1 first spaces of one of said arrays;

each of said sets of second fixing elements having a set of aligned holes, one in each of said second fixing elements positioned for alignment with the holes in the n first fixing elements of one of said arrays, at least one of said holes in each set of second fixing elements having a diameter smaller than that of the holes in the first fixing elements; and wherein each of said second fixing elements has perpendicular to the axis of the hole therein a cross section whose periphery at the side adjacent to the external surface of the bracelet half has a portion in a form of a circular arc centered on the axis of said hole and having a radius substantially equal to distance between said axis and said external surface portion of said masking wall portion when said bracelet is attached to said case.

* * * * *